US007373093B2

(12) United States Patent
Shinohara et al.

(10) Patent No.: US 7,373,093 B2
(45) Date of Patent: May 13, 2008

(54) APPARATUS AND METHOD FOR COLOR IMAGE FORMING, AND COMPUTER PROGRAM PRODUCT FOR DRIVER CONTROLLER

(75) Inventors: Tadashi Shinohara, Yokohama (JP); Masata Yokoyama, Yokohama (JP); Kazuhiko Kobayashi, Tokyo (JP); Yohei Miura, Tokyo (JP); Toshiyuki Yakahashi, Kawasaki (JP); Yuji Matsuda, Tokyo (JP); Jun Hosokawa, Tokyo (JP); Nobuto Yokokawa, Kawaguchi (JP); Toshiyuki Andoh, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 222 days.

(21) Appl. No.: 11/104,618

(22) Filed: Apr. 13, 2005

(65) Prior Publication Data

US 2005/0238372 A1 Oct. 27, 2005

(30) Foreign Application Priority Data

Apr. 13, 2004 (JP) ..... 2004-117569

(51) Int. Cl.
*G03G 15/00* (2006.01)

(52) U.S. Cl. ..... 399/44; 399/301

(58) Field of Classification Search ..... 399/38, 399/39, 40, 42, 44, 298, 299, 301, 302, 303, 399/306, 308

See application file for complete search history.

(56) References Cited

U.S. PATENT DOCUMENTS 5,589,858 A * 12/1996 Kadowaki et al. ..... 347/14
6,246,857 B1 * 6/2001 Tanaka ..... 399/301
6,885,841 B2 * 4/2005 Harada et al. ..... 399/301
7,149,446 B2 * 12/2006 Saitoh et al. ..... 399/49
2005/0238372 A1 10/2005 Shinohara et al.

OTHER PUBLICATIONS

U.S. Appl. No. 11/555,476, filed Nov. 1, 2006, Shinohara.
U.S. Appl. No. 11/557,289, filed Nov. 7, 2006, unknown.
U.S. Appl. No. 11/496,510, filed Aug. 1, 2006, Shinohara.
U.S. Appl. No. 11/420,929, filed May 30, 2006, Matsuda.

* cited by examiner

*Primary Examiner*—Hoan Tran
(74) *Attorney, Agent, or Firm*—Oblon, Spivak, McClelland, Maier & Neustadt, P.C.

(57) ABSTRACT

A color image forming apparatus including a plurality of photosensitive drums on which toner images of different colors are respectively formed. An endless belt confronts the plurality of photosensitive drums. A drive source drives rotation of the endless belt, or alternatively plural drive sources drive the photosensitive drums to individually rotate. A memory stores pre-measured characteristics of a color misregistration of a color image in a sub-scanning direction of the apparatus, the color image formed by transferring images from respective of the plurality of photosensitive drums. Further, a control unit changes an average running speed of the endless belt, or alternatively an average running speed of at least some of the photosensitive drums, by controlling the drive sources, to compensate for color misregistration, based on the stored characteristics of color misregistration. The belt can either transport a paper sheet or have a color image formed thereon as an intermediate transfer device.

34 Claims, 8 Drawing Sheets

APPARATUS AND METHOD FOR COLOR IMAGE FORMING, AND COMPUTER PROGRAM PRODUCT FOR DRIVER CONTROLLER

CROSS-REFERENCE TO RELATED APPLICATIONS

This patent document is based on and claims priority to Japanese patent application No. 2004-117569 filed on Apr. 13, 2004, the entire contents of which are hereby incorporated herein by reference.

BACKGROUND OF THE INVENTION

1. Field of the Invention

The present invention generally relates to a color image forming apparatus, a method, and a computer program product for a driver controller of the color image forming apparatus, in which a plurality of electrophotographic image forming units are arranged along a conveying direction of an endless belt.

2. Description of the Background Art

There are generally two kinds of image transfer systems. One of them is a direct transfer system that transfers different color toner images formed on plural photosensitive drums directly onto a transfer paper, as a representative method, for color image formation. The other is an intermediary transfer system that transfers different color toner images formed on plural photosensitive drums onto an intermediary transfer device, and after that transfers all the toner images onto a transfer paper at the same time.

Image forming devices of the direct and intermediary transfer systems are referred to as Tandem type because plural photosensitive drums are arranged at an opposite side in a transfer paper or an intermediary transfer device. The Tandem type devices execute plural process such as formation of an electrophotographic image for each color of magenta (M), cyan (C), yellow (Y), and black (K) on each of respective photosensitive drums, and execute an electrophotographic process of developing. The Tandem type devices transfer images directly onto a transfer paper in the direct transfer system, and transfer images to an intermediary transfer device in the intermediary transfer system.

In a color image formation device of such a Tandem type system, a direct transfer system uses an endless belt as a paper conveyance belt running for supporting a transfer paper, and an intermediary transfer system uses an endless belt as an intermediate transfer belt for forming images thereon from photosensitive drums. In general, an image process unit including four photosensitive drums is set along the conveying direction of the endless belt. In such a structure, it is very important to ensure that each individual color image is overlaid preciously at the same position on either the transfer paper or the intermediate transfer belt, and thus it is important to control a position alignment technique between each color image in a color image forming apparatus of the Tandem system.

Various systems have conventionally been implemented for maintaining such a positional alignment for each color image.

For example, there is known a controlling method that forms toner patterns for adjusting each color on the endless belt and detects with a sensor a color misalignment and adjusts a writing timing of the optical writing unit based on any detected color misalignment.

In such a background art, for example Japanese Laid-Open patent Publication No. 2001-215857 (the entire contents of which are hereby incorporated herein by reference) describes that a color misregistration is prevented by changing a conveyance speed of a transfer device conveyance depending on a lap length of a transfer conveyance device resulting from an environmental change and a temperature rise in a device (endless belt).

In a color image formation device of a so-called Tandem system, color misregistration can easily result between each of the colors to be formed. The main causes of the color misregistrations are Skew difference, a registration difference in a sub-scanning direction, a magnification error in a main-scanning direction, a registration difference in a main-scanning direction, etc.

The above-mentioned toner pattern system is described as follows referring to FIG. 11. FIG. 11 shows toner pattern lines 201 for a color adjustment formed on an endless belt 200, which e.g. is a sheet conveyance belt. In the toner pattern lines 201, horizontal lines and diagonal lines of each of colors K, Y, C, M are formed and these pattern lines are detected by sensors 202-204 set in a main-scanning direction. Using outputs of the sensors 202-204, an amount of a skew difference, a registration difference in a sub-scanning direction, a registration difference in a main-scanning direction, and a magnification difference in a main-scanning direction relative to a main color (in this case, Black (K)), are all calculated. Based on the calculation results a main CPU makes a correction of each color misalignment.

A correction of a skew difference is realized by modifying a slope of a mirror that reflects the laser light of each color in an optical writing unit. A stepping motor is used with a driver to change the slope of the mirror. The corrections of registrations in a main-scanning and in a sub-scanning directions are realized by adjusting a start-writing timing. Also, based on the result of a mark detection and calculation, when there is a misalignment of the main color about a magnification in a main-scanning direction, the device can change the frequency with a very small step, for example a clock generator can change the magnification.

However, when such a toner pattern system forms toner patterns of each color and makes an automatic color detection by detecting these patterns, down time of the machine occurs and copy productivity will be lost. Especially considering the color difference in a sub-scanning direction, the speed change of an endless belt should be considered, and actually toner pattern lines 201 shown in FIG. 11 are formed plural times (for example, eight sets are formed) in a sub-scanning direction. For calculating an average of the results of the detection, a toner pattern is formed by merely a timing of paper intervals, and thereby a long down time of a machine in such conditions cannot be avoided. The term "down time" in this context indicates a time that the device in FIG. 11 needs to form the toner patterns 201 and to calculate any color differences based on detecting those toner patterns 201 with the sensors 202-204. That is, forming the toner patterns 201 and processing data from detecting the toner patterns 201 requires time during which image formation cannot be effectuated, resulting in a down time in image formation.

The above patent document JP 2001-215857 discloses changing a lap length of an endless belt that occurs by a temperature rise, and the conveyance speed of an endless belt is controlled according to the change of the lap length. However, it is not enough to correct a color misalignment only paying attention to the change of a lap length of an endless belt because a color misalignment in a sub-scanning direction results not only from a change of a lap length of an endless belt, but also by results compounded from an influence of an optics device in an optical writing unit, a speed change of the endless belt, a stretching of the device housing itself, etc.

SUMMARY OF THE INVENTION

An object of the present invention is to provide a novel image forming apparatus that addresses the above-noted and other drawbacks in the background art.

A more specific object of the present invention is to compensate for a color misregistration in a sub-scanning direction appropriately without generating much down time in a novel image forming apparatus.

The present invention achieves the above and other objects by providing a novel color image forming apparatus that includes a plurality of photosensitive drums on which toner images of different colors are respectively formed. An endless belt confronts the plurality of photosensitive drums. A drive source unit drives a rotation of the endless belt, or alternatively plural drive source units drive the photosensitive drums to individually rotate. A memory unit stores pre-measured characteristics of a color misregistration of a color image in a sub-scanning direction of the apparatus, the color image formed by transferring images from respective of the plurality of photosensitive drums. Further, a control unit changes an average running speed of the endless belt, or alternatively an average running speed of at least some of the photosensitive drums, by controlling the drive sources, to compensate for color misregistration, based on the stored characteristics of color misregistration.

In the present invention the endless belt can be either a belt that transports a paper sheet onto which images from the photosensitive drums are directly transferred, or can be an intermediate transfer belt onto which images from the photosensitive drums are transferred, and which in turn then transfers the images from the intermediate belt onto a transfer paper sheet at the same time.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings.

DETAILED DESCRIPTION OF THE PREFERRED EMBODIMENTS

Figure 1:
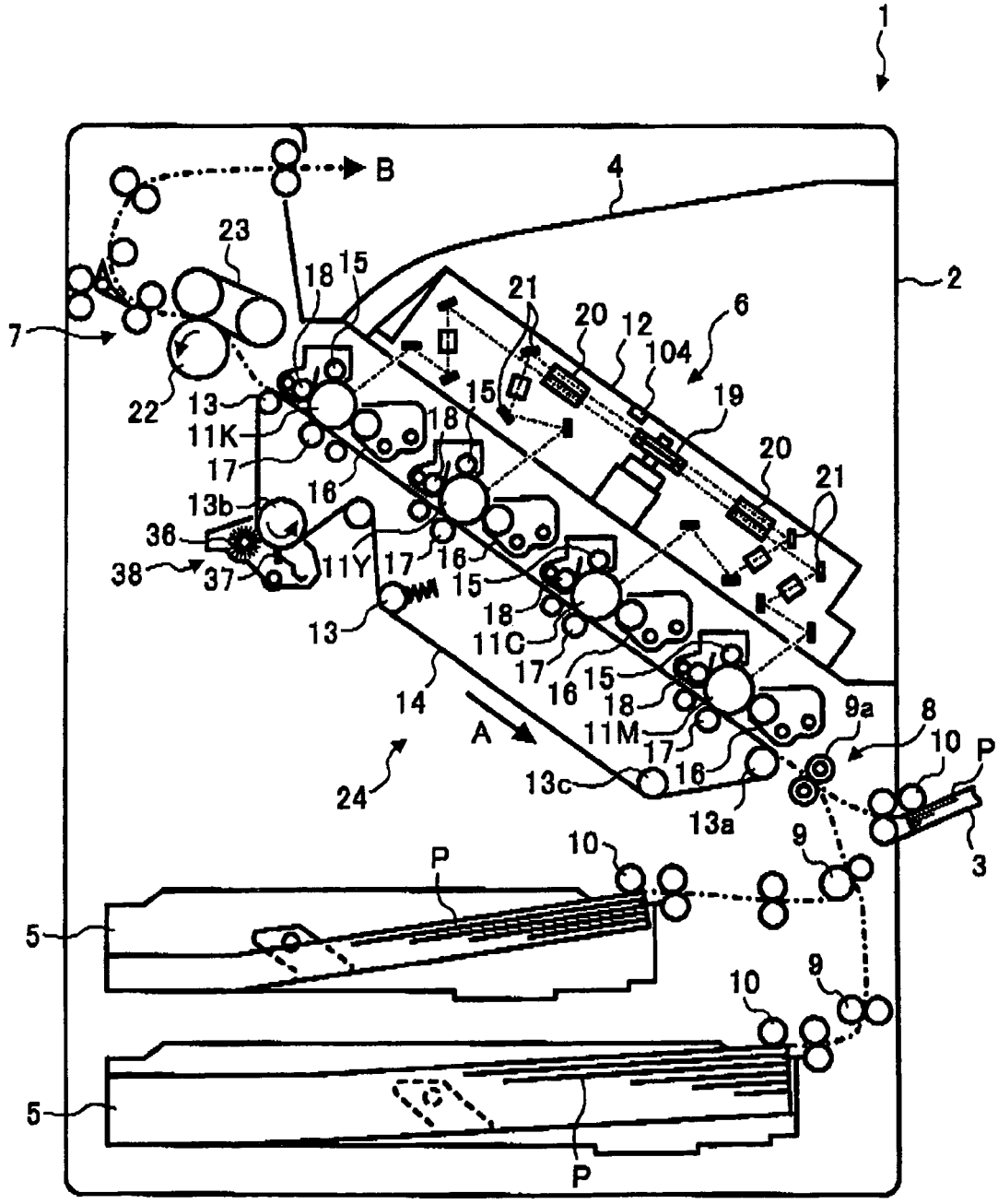
FIG. 1 is a profile side view showing a constitution of an example of a color laser printer of one detailed description of a preferred embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

A non-limiting preferred embodiment to execute the present invention is described in conjunction with the drawings. A color image formation device of this detailed description of the preferred embodiment is applied as a non-limiting example to a full-color laser printer with a direct transfer system to adopt an electrophotographic system.

Figure 2:
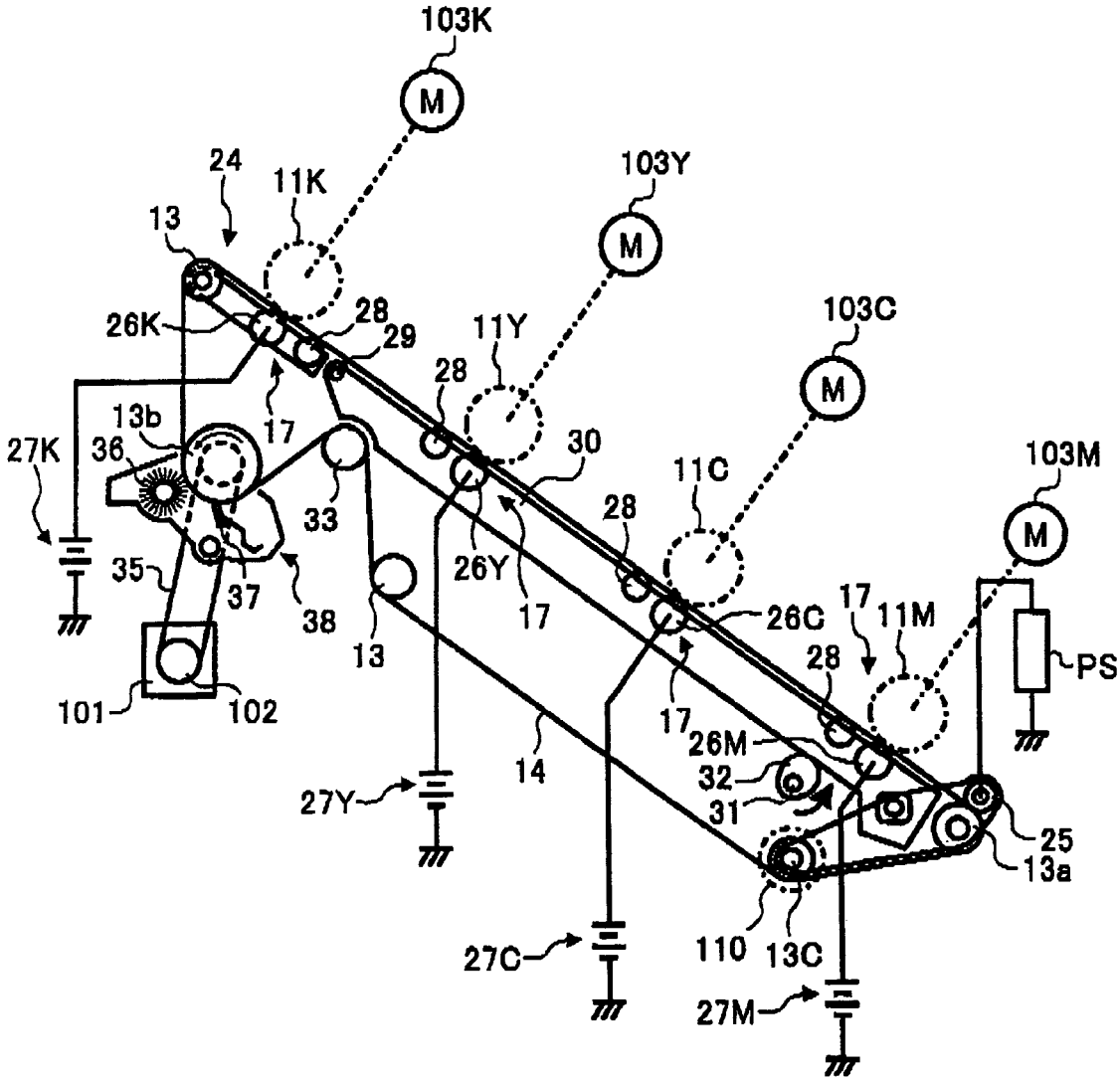
FIG. 2 is a side view outline structure of a transfer unit of the device of FIG. 1.

At first with reference FIG. 1 and FIG. 2, a basic constitution of a color image formation device (a color laser printer) is explained.

FIG. 1 is a vertical section side view that shows a constitution example of a color image formation device (a color laser printer). A color laser printer 1 of this detailed description of the preferred embodiment includes a paper feed tray 3 that holds a pile of transfer papers P as a transfer medium on one side of a printer housing 2, and includes a discharge stacker unit 4 onto which transfer paper P is output after a printing operation in the printer housing 2. At an upper side of the printer housing 2, an operational unit that accepts inputs from an operator and a display unit that displays various information (not shown) are provided.

The printer housing 2 includes two sheet cassettes 5 to hold plural transfer paper P inside the printer. Also inside the printer housing 2, a transfer paper guide path 8 is formed that guides a transfer paper P feed from paper feed cassettes 5 or paper feed tray 3 to the discharge stacker unit 4 via an image processing unit 6, an image forming unit 7, etc. In transfer paper guide path 8, plural pairs of conveyance roller pairs 9 are arranged to convey a transfer paper P. The conveyance roller pairs 9 are driven by a conveyance motor (not illustrated) and convey transfer paper P along a desired path on the transfer paper guide path 8. Conveyance roller pairs 9 arranged just before the image processing unit 6 in the guide direction of transfer paper P in the transfer paper guide path 8 are operated with registration roller pair 9*a*. And, a paper feed mechanism 10 is provided for each paper feed cassette 5 and for the paper feed tray 3. The paper feed mechanisms 10 feed transfer paper P held in the paper feed cassette 5 or in the paper feed tray 3 to the transfer paper guide path 8.

The image processing unit 6 includes plural photosensitive drums 11 (11M, 11C, 11Y, 11K) forming toner images corresponding to M(Magenta), C(Cyan), Y(Yellow), K(Black). These photosensitive drums 11 are arranged in order of 11M, 11C, 11Y, 11K from the right side in FIG. 1. The surface of these photosensitive drums 11 is scanned by the optical writing unit 12 at image formation.

Each photosensitive drum 11M, 11C, 11Y, 11K is exposed to paper conveyance belt 14, which is an endless belt wound around plural rollers 13 to rotate freely in one direction. The paper conveyance belt 14 has a function of conveying transfer paper P by rotating following with the rotation of rollers 13, and also has a function of pushing a conveying transfer paper P past each photosensitive drum 11 (11M, 11C, 11Y, 11K).

On the circumference of each photosensitive drum 11, there are arranged a charging electricity device 15 that charges a respective surface of photosensitive drums 11M, 11C, 11Y, 11K, an optical writing unit 12 that is an optical exposure device forming a prescribed image on a surface of each of photosensitive drums 11M, 11C, 11Y, 11K by scanning the photosensitive drums 11M, 11C, 11Y, 11K, a developing device 16 forming a toner image of prescribed colors to adhere to each image, a transfer device 17 transferring to a transfer paper P toner images formed on the surfaces of the photosensitive drums 11M, 11C, 11Y, 11K by applying a transfer bias via the paper conveyance belt 14, and cleaner 18 for removing toner remaining on surfaces of photosensitive drums 11M, 11C, 11Y, 11K by removing electric charges on the surfaces of the photosensitive drums 11M, 11C, 11Y, 11K, and so on.

The optical writing unit 12 includes an optical source (not illustrated), polygon mirror 19, f-θ lens 20, a refraction mirror 21, and so on, and irradiates laser light for scanning the surface of each photosensitive drum 11M, 11C, 11Y, 11K corresponding to image data. A temperature sensor detects a temperature in the optical writing unit 12 as an environmental temperature in the apparatus (a color laser printer 1), for example thermistor 104 is arranged at a prescribed position in the optical writing unit 12.

The image fixing unit 7 is composed of an image fixing belt 23 applying pressure against the pressure roller 22 to fix a toner image on the transfer paper P with pressure and heat against the transfer paper P passing through the image forming unit 7.

FIG. 2 shows a side view outline structure of certain elements from FIG. 1, and specifically shows a transfer unit 24. The paper conveyance belt 14 mentioned above and plural rollers 13 holding the paper conveyance belt 14 to rotate freely compose the transfer unit 24. The paper conveyance belt 14 used in the transfer unit 24 can preferably be a high resistance endless belt with a volume specific resistance at $10^9$-$10^{11}$ Ω cm and is made of PVDF (a polyvinylidene fluoride). This paper conveyance belt 14 is wound around plural rollers 13 passing each transfer position opposite each photosensitive drum 11M, 11C, 11Y, 11K of the image processing unit 6.

At an input roller 13*a*, an electrostatic absorption roller 25 biased at a prescribed voltage from power supply PS is placed against a peripheral outside of the paper conveyance belt 14. The transfer paper P is attracted electrostatically on the paper conveyance belt 14 passing between input roller 13*a* and the electrostatic absorption roller 25.

The transfer device 17 forms a transfer electric field in each transfer position. In other words, at positions opposite each photosensitive drum 11M, 11C, 11Y, 11K, transfer rollers 26M, 26C, 26Y, 26K are arranged to function as a transfer bias applying device. These transfer rollers 26M, 26C, 26Y, 26K can be bias rollers made of a sponge and other layers circumferentially. The transfer bias is applied from each transfer bias power supply 27M, 27C, 27Y, 27K to the center metallic core of respective transfer rollers 26M, 26C, 26Y, 26K. The transfer charge is applied to the paper conveyance belt 14 by the operation of transfer applied bias. The predetermined strength of the transfer electrical field is formed between the paper conveyance belt 14 and the surfaces of the photosensitive drums 11M, 11C, 11Y, 11K at each transfer position. The transfer device 17 maintains adequate contact between transfer paper P in the transfer area and each photosensitive drum 11M, 11C, 11Y, 11K and includes plural backup rollers 28 to achieve good transfer nipping. Additionally, in this detailed description embodiment, the exposure position to form an image at each photosensitive drum 11M, 11C, 11Y, 11K and the transfer onto each photosensitive drum can be arranged at positions offset by 180°.

In the transfer device 17, the transfer rollers 26M, 26C, 26Y and the backup rollers 28 arranged around the transfer rollers are held to turn freely with a swing bracket that can turn freely around the center of axis 29. The swing bracket 30 swings clockwise by pivoting cam 32 fixed with camshaft 31 in the direction shown by the arrow and releases the contact of the transfer rollers 26M, 26C, 26Y via the paper conveyance belt 14 against each photosensitive drum 11M, 11C, 11Y. By such a mechanism, it is possible to avoid contact of the photosensitive drums 11M, 11C, 11Y and the paper conveyance belt 14 in a case of forming only a black image.

The paper conveyance belt 14 rotates driven by a stepping motor 101 with the driving roller 13*b* of the plural rollers 13 as the driving source. As a power transmission structure for that purpose, in the detailed description of the preferred embodiment a power transmission belt 35 hangs on between the axis 102 of the stepping motor 101 and the axis of the driving roller 13*b*. Pressure roller 33 is arranged to push the paper conveyance belt 14 from its outer circumferential respect at the surroundings of the roller 13*b* and in the downstream side of the conveyance direction of the paper conveyance belt 14 from the driving roller 13*b*. The pressure roller 33 maintains a winding angle of the paper conveyance belt against the driving roller 13*b* and increases a frictional force of driving roller 13*b* against the paper conveyance belt 14.

Cleaning device 38, which is composed of a brush roller 36 and cleaning blade 37, is placed to contact the outer surrounding layer of the paper conveyance belt 14 winding around the driving roller 13*b*. The cleaning device 38 removes foreign objects such as toner and so on that accumulate on the surface of the paper conveyance belt 14.

Stepping motors 103M, 103C, 103Y, 103K, which are the driving sources to drive each respective photosensitive drum individually, are connected with each respective photosensitive drum 11M, 11C, 11Y, 11K.

In the structure, the transfer paper P fed from the feed cassette 5 or the feed tray 3 to the transfer guidance path 8 by the paper feed mechanism 10 is conveyed by the conveyance roller pairs 9 and is guided by a conveyance guide (not illustrated) and is sent to a position to stop temporarily at the registration roller pair 9*a*, and is stopped temporarily at that position. The transfer paper P after being stopped temporarily is sent out to the image processing unit 6 by the registration roller pair 9*a* at a prescribed timing and is held by the paper conveyance belt 14 and is conveyed to each photosensitive drum 11M, 11C, 11Y, 11K. At appropriate timings, each photosensitive drum is charged by respective charging devices 15, an electrostatic image formation of each color is performed by the optical writing unit 12, and toner images are formed by a toner adhering to the electrostatic images in the developing devices 16. By these operations, a toner image is transferred to a transfer paper P by the operation of the transfer electric field and a nipping pressure at the transfer nipping units when the transfer paper P reaches the transfer nipping unit located between each photosensitive drum 11M, 11C, 11Y, 11K and each respective transfer roller 26M, 26C, 26Y, 26K. With this operation toner images of each color are made to be formed in turn at each photosensitive drum 11M, 11C, 11Y, 11K, and thereby a full color image is formed on the transfer paper P.

In addition, the surfaces of the photosensitive drums 11M, 11C, 11Y, 11K after a toner image is transferred are cleaned by respective cleaners 18 and are prepared for formation of the next electrostatic images.

Figure 3:
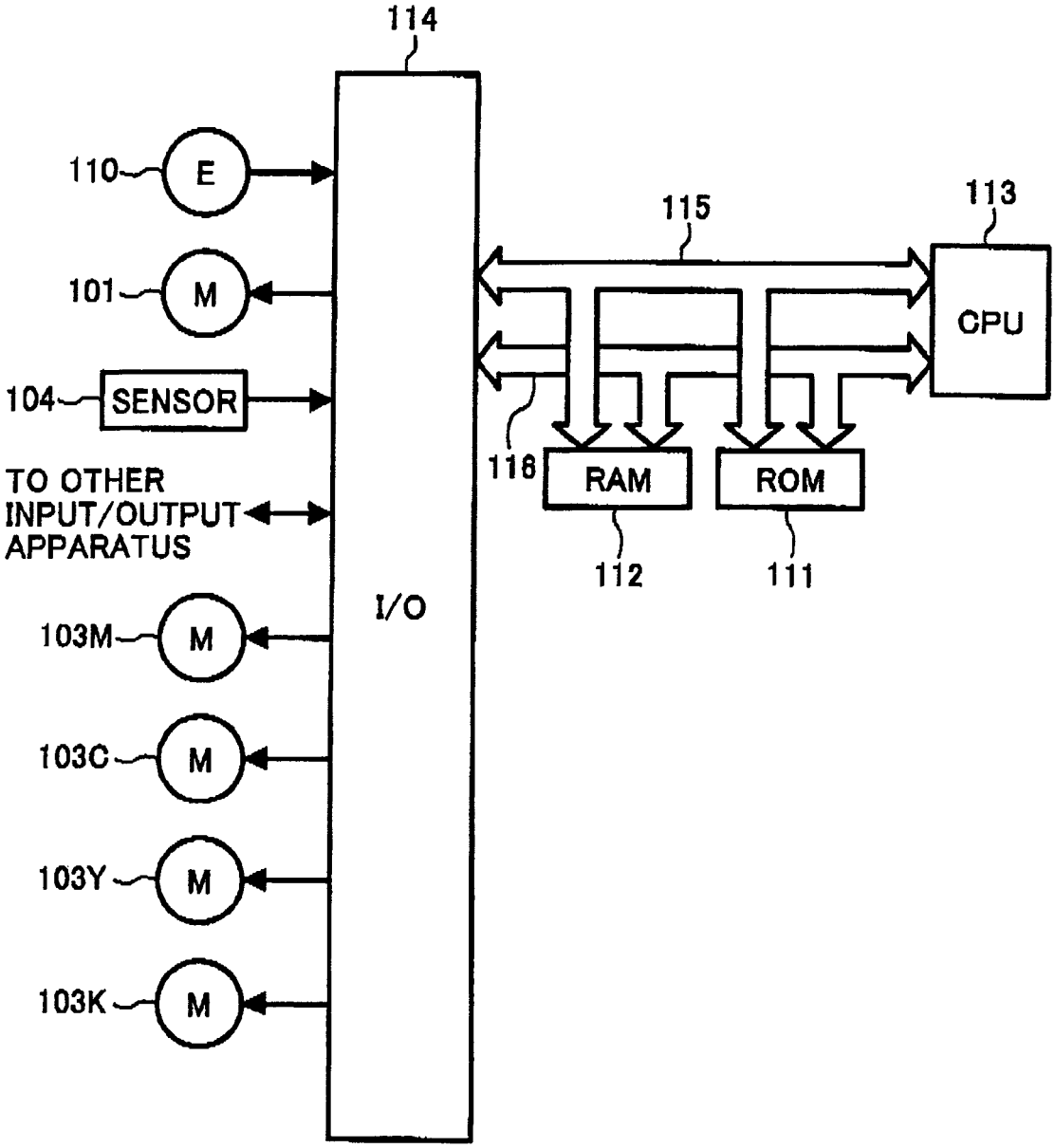
FIG. 3 is a schematic block diagram showing an outline constitution example of a control system of the device of FIG. 1.

An outline constitution example of a control system of the detailed description of the preferred embodiment is now explained referring to the schematic block diagram shown in FIG. 3. In the control system a CPU 113 composed with a ROM 111 and RAM 112 is arranged. This CPU 113 controls the color printer system 1 including driving control of the stepping motor 101 for the paper conveyance belt 14, and the driving control of the stepping motors 103M, 103C, 103Y, 103K for each photosensitive drum 11M, 11C, 11Y, 11K based on a driving control program stored in ROM 111. RAM 112 is used as a working area for storing temporarily the necessary data for executing various processings. The driving control program and other various programs are stored in ROM 111, which functions as a memory unit. One specific stored program stores predetermined measured color misregistration characteristics in the sub-scanning direction of the color printer 1 in ROM 111, as further discussed below. The color misregistration characteristics in the sub-scanning direction can also be stored in a memory area in a nonvolatile RAM, a battery back-up RAM, an EEPROM, and so on.

Other various input/output devices such as the stepping motors 103M, 103C, 103Y, 103K which control the color laser printer 1 are connected via I/O interface 114. CPU 113, ROM 111, RAM 112, and I/O interface 114 are connected to address bus 115 and data bus 116 and control input and output of data and appointment of an address.

The storing of color misregistration characteristics of color laser printer 1 in a sub-scanning direction pre-stored in ROM 111 is now described. A color misregistration characteristic of this detailed description of the preferred embodiment is a color misregistration characteristic in the color laser printer 1, specifically a color misregistration relative to a standard color that is dependent upon environmental temperature in optical writing unit 12 (in this case black K).

Figure 11:
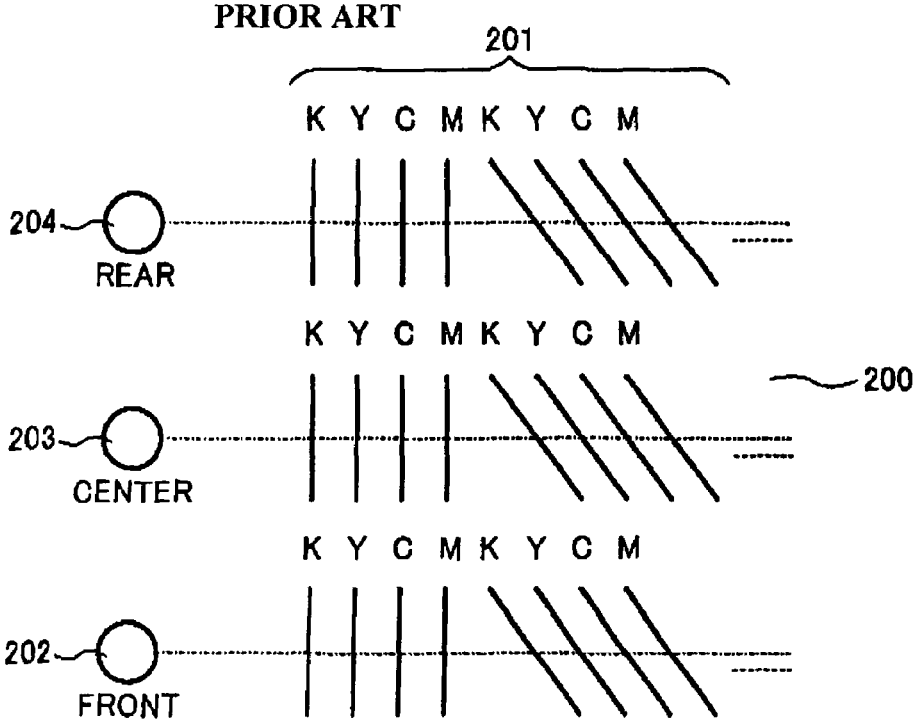
FIG. 11 PRIOR ART
FIG. 11 is an illustration showing a background toner pattern system.

That is, in the present invention instead of needing to form toner patterns onto an endless belt and then detect such toner patterns to calculate a color misregistration, such as in the background art of FIG. 11, information of color misregistration is pre-measured prior to an image forming device being shipped from a factory and provided to a user, and data of the pre-measured color misregistration is stored in a memory, i.e. ROM 111. Thus, in the operation in the present invention, to determine color misregistration depending upon an environmental temperature, the device of the present invention merely needs to access the ROM 111 to read the pre-stored color misregistration data, and effectuate a control to compensate for that read color misregistration, the control taking the form of either varying the speed of the intermediate belt 14 or the rotation speed of the photosensitive drums 11, as discussed in further detail below. Thus, the present invention can provide the benefit that an image forming device does not have significant down time such as the down time required in the background art of FIG. 11 to form the toner patterns 201 on the belt and to detect the toner patterns 201. The present invention avoids such processes by storing pre-measured data of color misregistration.

Figure 4:
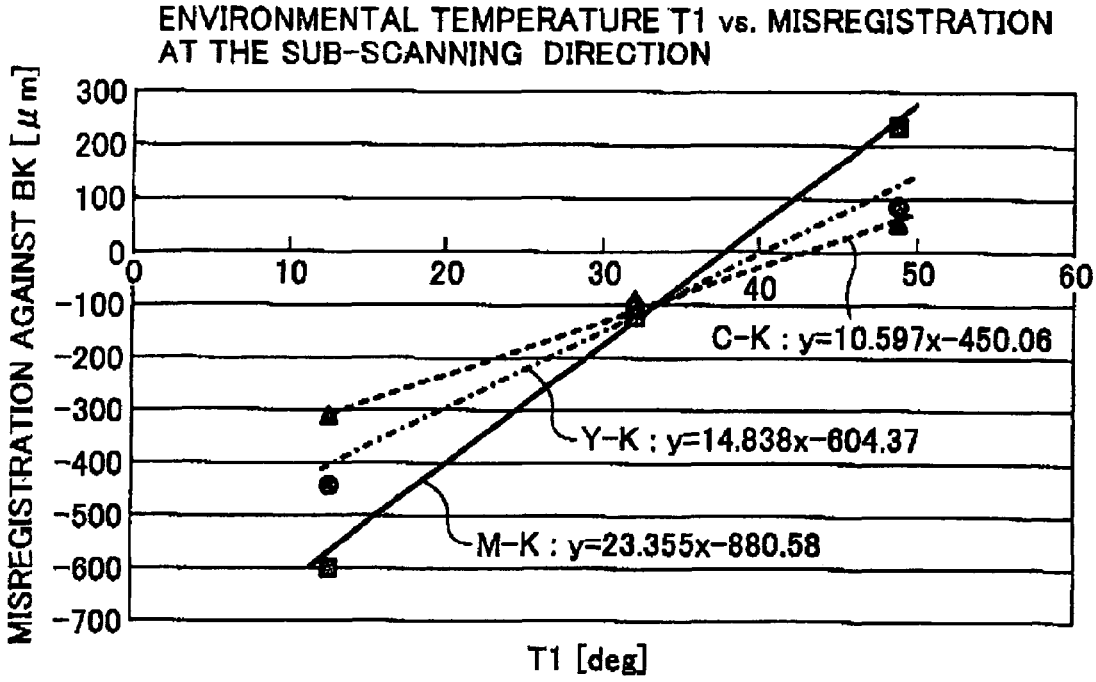
FIG. 4 is a characteristic chart showing a relation between an environmental temperature in an optical writing unit and color difference quantity in a sub-scanning direction that can be used in the device of FIG. 1.

For example, FIG. 4 shows the characteristics of relations of a quantity of color misregistration in a sub-scanning direction and environmental temperature in optical writing unit 12 detected by thermistor 104 which considers, for example, environmental temperature in optical writing unit 12 varying between 10-50 degrees, at a stage before factory shipment. The M-K characteristics show the color misregistration of the color magenta M relative to standard color black K, the C-K characteristics show the color misregistration of the color cyan C relative to standard color black K, the Y-K characteristics show the color misregistration of the color yellow Y relative to standard color black K in each characteristic of FIG. 4. Such a color misregistration quantity in a sub-scanning direction increases as a result compounded by various factors such as of the f-θ lens 20 in optical writing unit 12, influence of a position change of the reflection mirror 21 etc., a speed change of paper conveyance belt 14, stretching of printer housing 2 in itself, and so on. Such color misregistrations are not always consistent for every color in the laser printer 1 and each color laser printer 1 may have distinctive quantities for such color misregistrations.

For the characteristics as shown in FIG. 4, there is a correlation between environmental temperature and an interval of an amount of color misregistration, so in the detailed description of the preferred embodiment a device internal environmental temperature is detected as one factor producing a color misregistration of the sub-scanning direction. Color misregistration characteristics compounded from various elements measured beforehand in conjunction with a parameter of the environmental temperature T1 are stored in ROM 111.

Considering the characteristics as shown in the FIG. 4, a change rate of a misregistration quantity dependent on an environmental temperature of each color for a case illustration as an example can be as follows. As the magenta M photosensitive drum 11M is furthest from the standard black K photosensitive drum 11K, the misregistration from M to K is the largest misregistration.

$$\text{M-K: } 23.355\ [\mu m/deg]$$

$$\text{C-K: } 10.597\ [\mu m/deg]$$

$$\text{Y-K: } 14.838\ [\mu m/deg] \tag{1}$$

A distance of a transfer point of each photosensitive drum 11M, 11C, 11Y, 11K compared with a transfer point of black K (the standard point) on the paper conveyance belt 14 can be as follows.

$$M\text{-}K\text{: } 98*3=294\ [mm]$$

$$C\text{-}K\text{: } 98*2=196\ [mm]$$

$$\text{Y-K: } 98=98\ [mm] \tag{2}$$

Therefore, a change rate of a misregistration quantity considering each distance of a transfer point from these expressions (1), (2) is as follows.

$$M\text{-}K\text{: } 23.355/294=0.07944*10^{-3}\ [/deg]$$

$C\text{-}K$: $10.597/196=0.05407*10^{-3}$ [/deg]

$Y\text{-}K$: $14.838/98=0.15141*10^{-3}$ [/deg] (3)

As the paper conveyance belt 14 is a common movement and the drive of the paper conveyance belt 14 cannot be controlled by every color unit, the mean between colors of a change rate of each transfer point color misregistration in consideration of the above transfer distances is calculated to be as follows.

The mean value: $0.09497*10^{-3}$ [/deg] (3')

Therefore, the characteristic shown by the expression (3') is stored in ROM 111 as the characteristic to compensate for color misregistration in the sub-scanning direction, when environmental temperature detected by thermistor 104 is varied by 1[deg]. Thereby, a color misregistration can be prevented or decreased by controlling the stepping motor 101 to modify the average running speed of the paper conveyance belt 14 to change by only a ratio of $0.09497*10^{-3}$ per degree of change of temperature.

Figure 5:
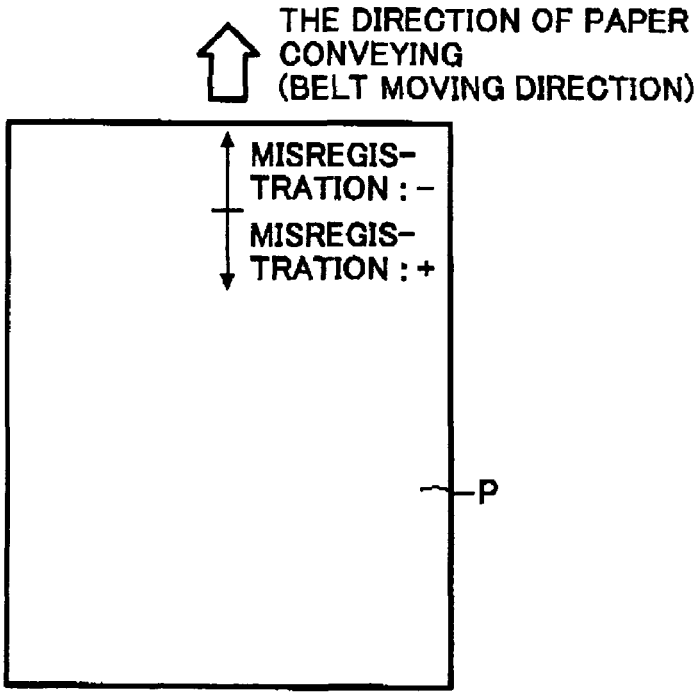
FIG. 5 is an illustration showing a relation of a misregistration direction and a conveyance direction of an image on transfer paper.

Considering a relation of a misregistration direction and a conveyance direction of an image on transfer paper P, as shown in FIG. 5 when environmental temperature rises, the misregistration slips off in the (+) side, and when the environmental temperature drops, the misregistration slips off in the (−) side. Therefore, it is preferable that in the case the detected temperature T1 is higher than a temperature at a previous temperature detection, the stepping motor 101 is controlled such that the average traveling speed of the paper conveyance belt 14 becomes faster; conversely in the case the detected temperature T1 is lower than a temperature at a previous temperature detection, the stepping motor 101 is controlled such that the average traveling speed of the paper conveyance belt 14 becomes slower. Actually, the timing control to modify the average speed of the paper conveyance belt 14 is controlled for example to be at a timing when a transfer process for transferring a color image is not still being executed with the paper conveyance belt 14. The reason is because an error image may be produced and image formation movement may not be performed normally when the speed change is executed during a transfer process. That is, it is preferable to not change the running speed of the paper conveyance belt 14 when for example only the magenta M and cyan C images have been formed thereon, and the yellow Y and black K images are still to be formed thereon to form a same color image. Thus, preferably in the present invention the running speed of the paper conveyance belt 14 is only changed when the transfer process is not being executed for a single color image. Only after all the individual color images of magenta M, cyan C, yellow Y, and black K are superimposed upon each other on a transfer paper sheet is the traveling speed of the paper conveyance belt 14 changed. Such a timing control avoids an adverse influence in forming a full color image.

Figure 6:
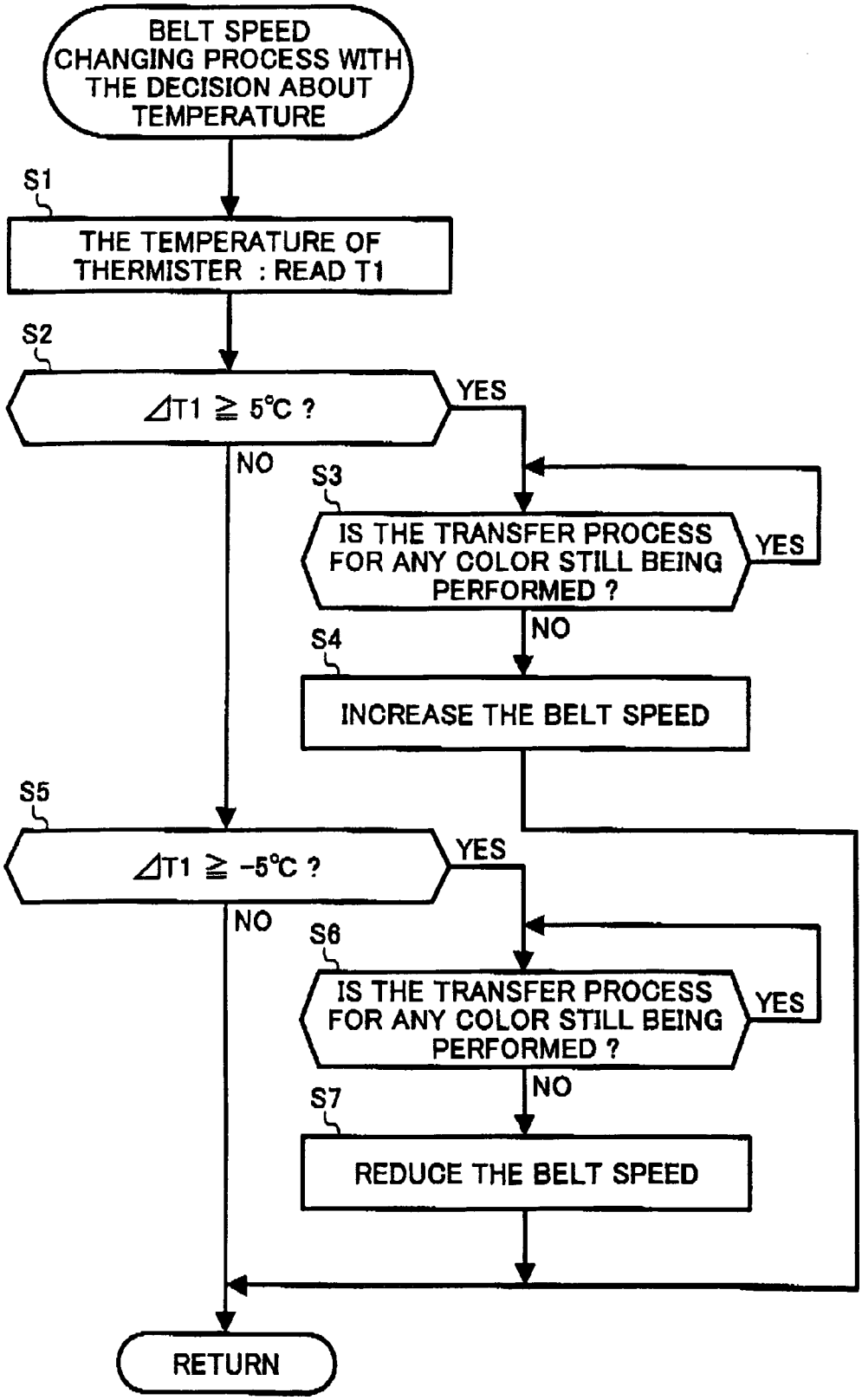
FIG. 6 illustrates a schematic view of an outline flow chart that shows speed control of a paper conveyance belt that can be used in the device of FIG. 1.

In consideration of these points, an example of a speed control of paper conveyance belt 14 executed as a control, a control process, and a control process by CPU 113 corresponding to a driving control program stored in ROM 111 is explained referring to an outline flow chart shown in FIG. 6. In addition it is assumed that a timing is set to control the stepping motor 101 when the environmental temperature detected by thermistor 104 changes 5° C. from a threshold environmental temperature (predetermined value). At first, as shown in FIG. 6, environmental temperature information detected by thermistor 104 is read (step S1). When the read environmental temperature information is compared with the last read environmental temperature (predetermined value) and the difference Δ T1 is greater than or equal to 5 degrees (Yes in step S2), the control operation checks whether a transfer process for any color is still being performed at that time (step S3). If each color has been formed and the transfer process is not still being performed (No in step S3), then the system controls to reduce the average running speed of the stepping motor 101 (step S4) in accordance with the characteristic of expression (3').

On other hand, when the read environmental temperature information is compared with the last environmental temperature information (a predetermined value), and in the case the difference Δ T1 decreases by more than or equal to −5 degrees (No in step S2, Yes in step S5), it is again checked whether a transfer process for any color is still being executed at that point (step S6). If each color has been formed and the transfer process is not still being performed (No of S6), then the system controls to reduce the average running speed of the stepping motor 101 (step S7) in accordance with the characteristic of expression (3'). If No in step S5 the operation ends.

Figure 7:
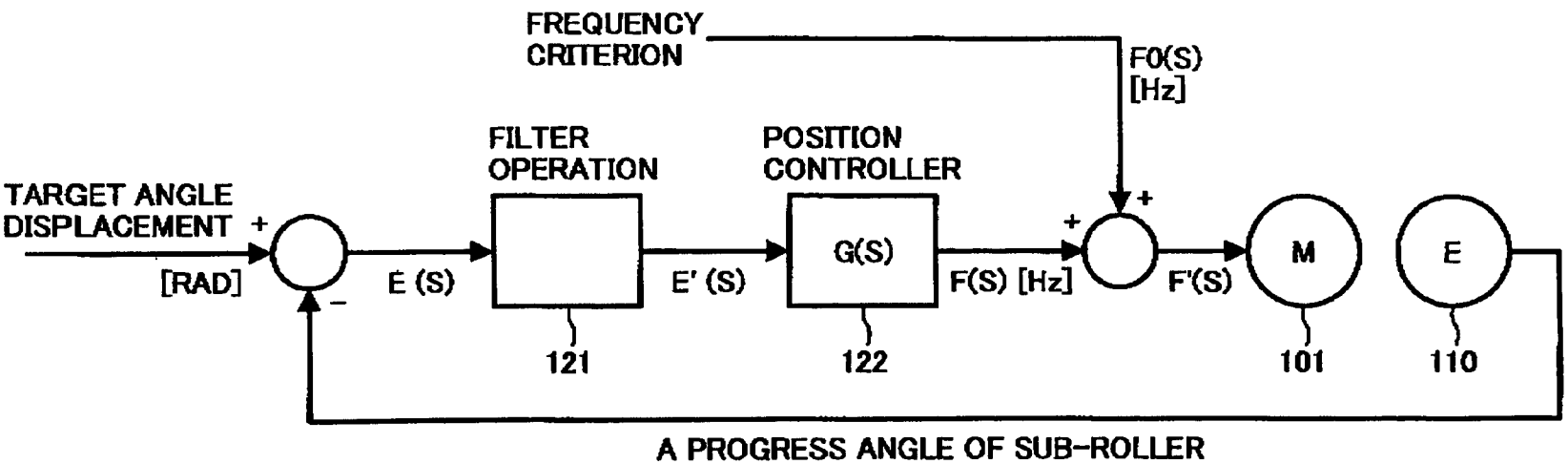
FIG. 7 is a functional block diagram showing a constitution example of a feedback control system that can be used in the device of FIG. 1.

As another and possibly more practical control example, a control system can include controlling a feedback to control detecting a moving distance or a moving quantity of the paper conveyance belt 14 for traveling stabilization of the paper conveyance belt 14, to modify the average running speed of the paper conveyance belt 14 appropriately and easily by modifying a target value given to the feedback system in accordance with a detected environmental temperature. FIG. 7 is a functional block diagram showing a constitution example of this feedback control system.

A rotary encoder 110 (as a detector) is arranged to detect the rotation speed for a driven roller 13*c* of one of rollers 13 supporting the paper conveyance belt 14. A progress degree [rad] of the driven roller 13*c* from a number of pulses in an encoder pulse output from rotary encoder 110 by a control period timer internal of the CPU 113 is compared with a target angular movement [rad] (as a mechanism to detect a positional deviation or to calculate a speed deviation) to give signal E(S). A filter operation (low pass filter operation) at the filter operation unit 121 cuts a high frequency element against a given deviation to give filtered signal E'(S). A PI control operation, for example by a position controller 122, outputs a modified driving pulse frequency F(S) added with the standard frequency F0(S) [Hz] (as a control). The system should be designed so that there is no slip between the driven roller 13*c* and the paper conveyance belt 14, and an angular movement of the driven roller 13*c* should be equal to a moving distance of a paper conveyance belt 14.

The control in FIG. 7 can modify an average speed of the paper conveyance belt 14 by modifying a target angular movement as a target value. With such a control, when a detected current environmental temperature T1 is higher than a last detected environmental temperature, then the target angular movement is increased, and accordingly the stepping motor 101 controls the average conveyance speed of paper conveyance belt 14 to become faster. Conversely, when a detected current environmental temperature T1 is lower than a last detected environmental temperature, then the target angular movement is decreased, and the stepping motor 101 controls the average conveyance speed of paper conveyance belt 14 to become slower.

In the above detailed description of the preferred embodiment, the stepping motor 101 is controlled to modify the average running speed of the paper conveyance belt 14 for correcting a color misregistration. However, in a modification of this preferred embodiment of the present invention, instead of modifying the average running speed of the paper conveyance belt 14, the running or rotation speeds of the photosensitive drums 11M, 11C, 11Y can be modified. The paper conveyance belt 14 is moved relative to the photosensitive drums 11M, 11C, 11Y, 11K, so as an alternative operation the stepping motors 103M, 103C, 103Y can modify the average speed of each photosensitive drum 11M, 11C, 11Y relative to a photosensitive drum 11K, which is used as a standard, instead of controlling to modify the average running speed of the paper conveyance belt 14.

For example, under the condition shown in FIG. 4, if the diameter of each photosensitive drum 11M, 11C, 11Y, 11K is 30 [mm] and their constitution of exposure point and transfer point are offset by 180 degrees, then the distance between the exposure point and transfer point in each photosensitive drums is as follows.

$$30*3.14/2=47.10 \text{ [mm]} \quad (4).$$

A change of a color misregistration amount shown in expression (1) can be realized if the average speed of the photosensitive drum is changed according with the environmental temperature. Concretely, the stepping motors 103M, 103C, 103Y, 103K should be controlled to change a rate of the average running speed becomes as follows.

$$M\text{-}K: 23.355/47.10=0.49586*10^{-3} \text{ [/deg]}$$

$$C\text{-}K: 10.597/47.10=0.22499*10^{-3} \text{ [/deg]}$$

$$Y\text{-}K: 14.838/47.10=0.31503*10^{-3} \text{ [/deg]}$$

A control aspect in this case is the same as in the case of modifying the average running speed of paper conveyance belt 14. It is preferable in this case in which the detected temperature T1 is higher than a temperature at a previous temperature detection, the stepping motor 101 is controlled so that the average traveling speed of photosensitive drums 11M, 11C, 11Y becomes faster. Conversely, in the case in which the detected temperature T1 is lower than a detected temperature at a previous temperature detection, the stepping motor 101 is controlled so that the average traveling speed of photosensitive drums 11M, 11C, 11Y become slower. In these cases the speed of photosensitive drum 11K is not changed as that drum is used as the standard. Similarly as in the case of modifying the average running speed of the paper conveyance belt 14, the timing control to modify the average speeds of the photosensitive drums 11M, 11C, 11Y, is controlled for example to be at a timing when an image formation and a transfer process for transferring a color image is not still being executed. Again the reason is because an error image may be produced and image formation may not be performed normally when the speed change is executed during a transfer process execution.

An example of a speed control of photosensitive drums 11M, 11C, 11Y executed as a control, a control process, and a control process by CPU 113 corresponding to a driving control program stored in ROM 111 is the same as discussed above with respect to the outline flow chart shown in FIG. 6. Or using an encoder (not illustrated) on the axis of each photosensitive drum, a control to drive the photosensitive drums 11 by the feedback system shown in FIG. 7 can be executed, and it may be acceptable to change the average running speed of the photosensitive drums 11M, 11C, 11Y by changing the target value and in accordance with the detected environmental temperature.

Figure 8:
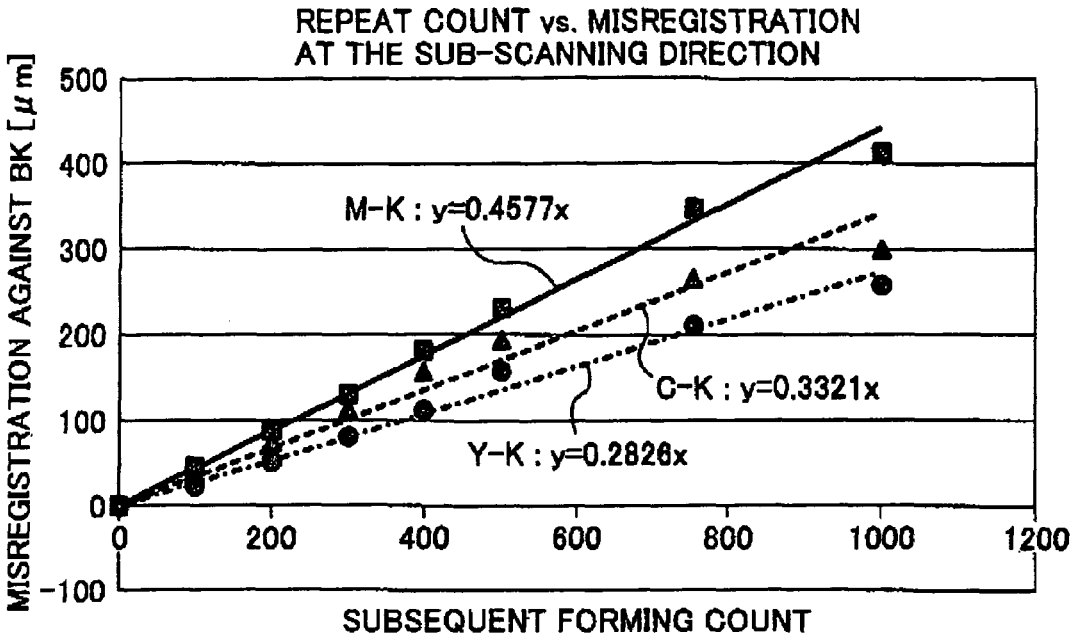
FIG. 8 shows a relation of a number of paper sheets on which images are continuously formed and color misregistration in a sub-scanning direction in another detailed description of a preferred embodiment of the present invention.
Figure 9:
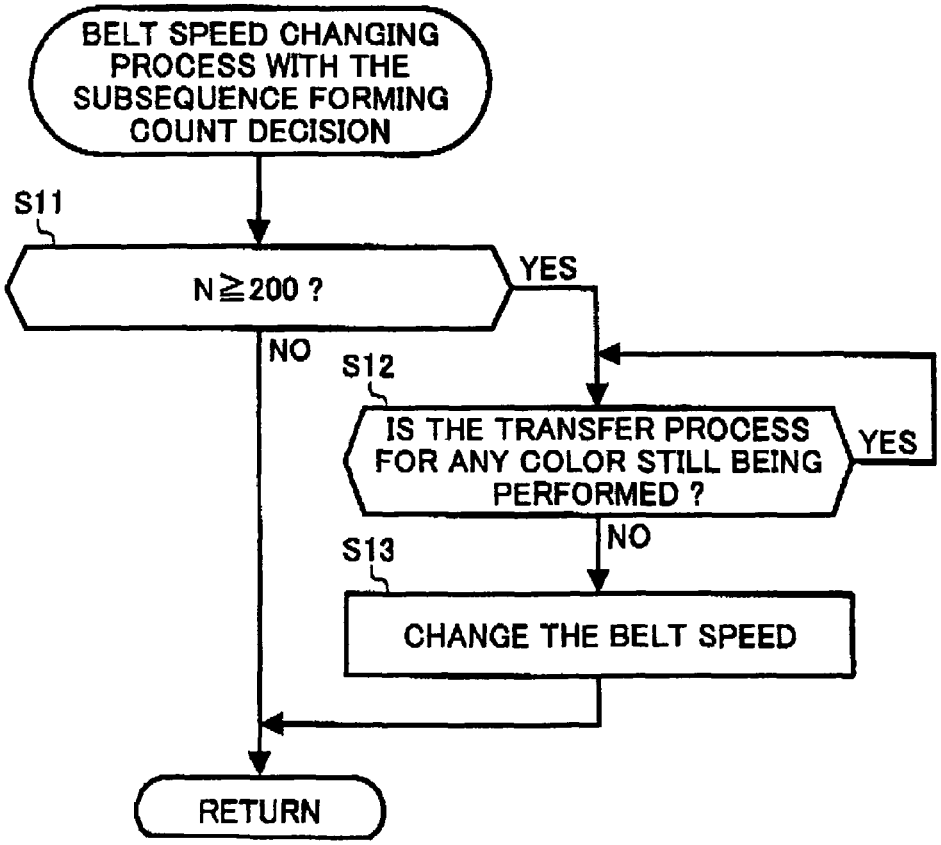
FIG. 9 is an outline flow chart that shows a speed control example of a paper conveyance belt that can be used in the device of FIG. 1.

Next, another detailed description of another preferred embodiment is described referring to FIG. 8 and FIG. 9. With the detailed description of this another preferred embodiment, a color misregistration characteristic in a sub-scanning direction of the color laser printer 1 that pre-stores data in ROM 111 is modified with one additional factor. In this further embodiment the color misregistration characteristics are color misregistration characteristics relative to the standard color (herein black K), but also factors in the number of paper sheets for printing on which images are continuously or consecutively formed. For example, FIG. 8 is a figure of characteristics showing the relation between the number of sheets on which images are continuously formed (for example the A4 size conversion number of sheets) in a case of executing a repeated printing until the number of sheets (=continuation paper number of sheets) becomes 1000 sheets, and the color misregistration amount in the sub-scanning direction. The reason why the number of images continuously and consecutively formed on paper sheets is relevant is that as more consecutive continuous images are formed on paper sheets, the temperature at the image forming positions will increase. To compensate for such an extra increase in the temperature, in a further embodiment of the present invention another factor that can be considered is the number of consecutive image forming operations executed.

In FIG. 8 the M-K characteristic shows a color misregistration characteristic of Magenta M relative to standard color black K. The C-K characteristic shows a color misregistration characteristic of Cyan C relative to the standard color black K. The Y-K characteristic shows a color misregistration characteristic of Yellow Y relative to the standard color black K. As mentioned above, such a color misregistration quantity in a sub-scanning direction increases as a result that is compounded by various factors of the f-θ lens 20 in optical writing unit 12, an influence of a position change of the reflection mirror 21 etc., a speed change of paper conveyance belt 14, stretching of printer housing 2 itself, and so on, and their characteristics are not always consistent for every color laser printer 1, and each color laser printer 1 may have distinctive quantities for such color misregistrations. As the characteristics as shown in FIG. 8, there is a correlation between environmental temperature and an interval with an amount of color misregistration, so in the detailed description of this preferred embodiment a device internal environmental temperature is detected as one factor producing a color misregistration in the sub-scanning direction. Thereby, the color misregistration characteristic as a result of compounding various elements measured beforehand in conjunction with a parameter of the environmental temperature T1, and further considering how many paper sheets have images consecutively formed thereon, is stored in ROM 111.

Furthermore, contemplating the characteristics shown in FIG. 8, the changing rate of the color misregistration quantity depending on the continuation paper number of sheets in each color can be as follows in the example of FIG. 4.

$$\text{M-K: } 0.4577 \text{ [μm/PCS]}$$

$$\text{C-K: } 0.3321 \text{ [μm/PCS]}$$

$$\text{Y-K: } 0.2826 \text{ [μm/PCS]} \quad (5)$$

And the distance of the transfer point in each color photosensitive drum 11M, 11C, 11Y, 11K relative to the transfer point of black K (the standard point) on the paper conveyance belt 14 is shown as mentioned above in expression (2).

Therefore, the average value between each color for the change rate of the color misregistration from expressions (2), (5) considered with the distance of each transfer point can be as follows. "/PCS" indicates a number of continuous paper sheets on which images are formed, which for example can equal 100 in this embodiment.

$$M\text{-}K: 0.4577/294=1.557*10^{-3}\ [/PCS]$$

$$C\text{-}K: 10.597/196=1.694*10^{-3}\ [/PCS]$$

$$Y\text{-}K: 14.838/98=10.20*10^{-3}\ [/PCS] \quad (6)$$

As the paper conveyance belt 14 is a common moving body, the average value of the change rate of the color misregistration between each color in consideration of the distance of each transfer point can be as follows.

$$\text{The mean value: } 4.48*10^{-3}\ [/PCS] \quad (6')$$

Therefore, the characteristic shown by the expression (6') is stored in ROM 111 as the characteristic for a color misregistration in the sub-scanning direction, every time the continuation paper number of sheets with printing operation exceed for example over 100 sheets. Thereby, a color misregistration can be prevented or decreased by controlling the stepping motor 101 to modify the average running speed of the paper conveyance belt 14 to change by only a ratio of $4.48*10^{-3}$ [/pcs], i.e. per 100 paper sheets continuously and consecutively having images formed thereon.

Actually, the timing control to modify the average speed of the paper conveyance belt 14 can again be controlled for example to be a timing when a transfer process for transferring a color image is not still being performed. Again the reason is because an error image may be produced and image formation may not be performed normally when the speed change is executed during a transfer process execution.

In consideration of these points, the example of speed control of paper conveyance 114 executed as a control, a control process, and a control process by CPU 113 corresponding to a driving control program stored in ROM 111 is explained referring to an outline flow chart shown in FIG. 9. In this case the tolerance of color misregistration is about 50 [μm] and the stepping motor 101 is controlled at the timing when a continuation paper number of sheets exceed or equal 200 pieces. For example, in the case the machine uses A3/A4 size commonly, the paper number of sheets at A3 size can be counted as 2 pieces of A4 size.

At first a counting mechanism (not illustrated) counts the continuous paper number of paper sheets on which images are continuously formed, and checks if the number exceeds or equals 200 sheets or not (step S11). If the continuation paper number of sheets reach 200 sheets (Yes in step S11), then the control operation checks whether the transfer processes for any color is still being performed or not (step S12). If Yes in step S12, then the control operation waits until it is finished that all the color images are formed, similarly as in steps S3, S6 in FIG. 6. If No in step S12 the operation proceeds to step S13, and controls the stepping motor 101 according to expression (6') to change the average running speed of the paper conveyance belt 14. If No in step S11 the operation ends.

In this detailed description of this preferred embodiment, the stepping motor 101 is controlled to modify the average speed of the paper conveyance belt 14 for correcting a color misregistration, but as an alternative operation the stepping motors 103M, 103C, 103Y can be controlled so that the average speed of each photosensitive drum 11M, 11C, 11Y is modified relative to a photosensitive drum 11K used as a standard, instead of modifying the average running speed of the paper conveyance belt 14, again similarly as discussed above.

Each detailed description of the preferred embodiment described above is directed to a color laser printer of the direct transfer system using a paper conveyance belt 14 as an endless belt for transporting a paper sheet, though the paper conveyance belt 14 is moved relative to the photosensitive drums 11M, 11C, 11Y, 11K, so alternatively stepping motors 103M, 103C, 103Y can be controlled so that the average speed of each photosensitive drum 11M, 11C, 11Y is modified relative to a photosensitive drum 11K used as a standard instead of the modifying average running speed of the paper conveyance belt 14.

Figure 10:
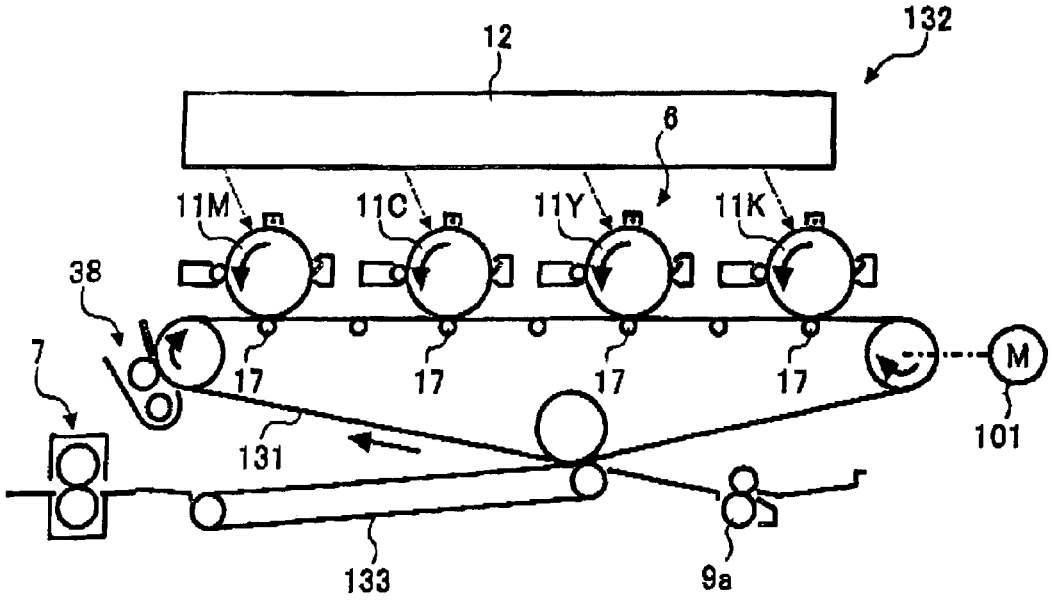
FIG. 10 is a vertical section side view that shows a constitution example of a color laser printer of an intermediate transfer system of a preferred embodiment of the present invention.

In each detailed description of the preferred embodiment described above, a color laser printer 1 of a direct transfer system is explained utilizing the paper conveyance belt 14, which is an endless belt. Alternatively, each embodiment of the present invention noted above can be applied to an intermediate belt 131 as an endless belt shown in FIG. 10 applied to a color laser printer 132 in an intermediate transfer system. In such a modification FIG. 10 shows a part of the same functioning elements of FIG. 1 or FIG. 2.

In the color laser printer 132, instead of the paper conveyance belt 14 shown in FIG. 1, an intermediate transfer belt 131 is provided. After toner images are formed on the photosensitive drums 11M, 11C, 11Y, 11K, the toner images are transferred onto the intermediate transfer belt 131 superposed on one another directly, and the resulting toner image on the intermediate transfer belt 131 is then transferred to a transfer paper P by the transfer belt 131 as a transfer device at one time. This transfer belt 133 also functions to convey transfer paper P to image forming unit 7.

In this case, controls that are the same as in the cases described above can be utilized to control the average running speed of the intermediate transfer belt 131, or the average running speed of each photosensitive drum 11M, 11C, 11Y, 11K can be controlled as a target of a control operation.

In above-mentioned detailed description of the preferred embodiment, an example using laser light as exposure light is shown, but the present invention is not limited to such an environment, for example to write optically by LED light by an LED array may be preferable. Also, the rotary encoder 110 fixed with the axis of a driven roller 13*c* at the time of detecting a speed and a position of a belt is shown, though again the present invention is not limited to this environment, and for example a system detecting a toner mark formed on a belt surface or a back side can be used. Also, stepping motors 101,103 are shown for driving sources, but alternatively a DC motor, AC motor, etc. may also be preferably used. The control operation by the controller is also not limited to a PI control, but a P control, PID control, H ∞ control, PLL control, etc. may also be preferably used.

Obviously, numerous modifications and variations of the present invention are possible in light of the above teachings. It is therefore to be understood that within the scope of the appended claims, the present invention may be practiced otherwise than as specifically described herein.

The invention claimed is:

1. A color image forming apparatus comprising:

a plurality of photosensitive drums on which toner images of different colors are respectively formed;

an endless belt confronting the plurality of photosensitive drums;

a drive source unit driving a rotation of the endless belt;

a memory unit storing pre-measured characteristics of a color misregistration of a color image in a sub-scanning direction of the apparatus, the color image formed by transferring images from respective of the plurality of photosensitive drums; and a control unit changing an average running speed of the endless belt by controlling the drive source to compensate for the color misregistration based on the stored characteristics of color misregistration.

2. The color image forming apparatus according to claim 1, wherein said control unit comprises:

a detecting unit detecting information of a running distance of the endless belt and a running speed of the endless belt;

a calculating unit calculating a position deviation or a speed deviation of the endless belt compared with a predetermined target value using the detected position deviation or the detected speed deviation;

an operation unit executing a predetermined feedback operation process based on the calculated position deviation or speed deviation and controlling the driving source based on a result of the feedback operation;

wherein the control unit changes the average running speed of the endless belt by changing the target value based on the stored characteristics of color misregistration.

3. The color image forming apparatus according to claim 2, wherein the characteristics of color misregistration in the sub-scanning direction are based on color misregistration relative to a standard color and are based on an environmental temperature in the apparatus, the apparatus further comprising:

a temperature sensor detecting the environmental temperature in the apparatus, wherein the controlling unit controls the drive source based on the detected environmental temperature in the apparatus and the stored characteristics of color misregistration.

4. The color image forming apparatus according to claim 3, wherein the temperature sensor is arranged in an exposure device to optically write on the photosensitive drums.

5. The color image forming apparatus according to claim 3, wherein the control unit increases the target value when the detected environmental temperature is higher than or equal to a predetermined value.

6. The color image forming apparatus according to claim 3, wherein the control unit decreases the target value when the detected environmental temperature is less than or equal to a predetermined value.

7. The color image forming apparatus according to claim 3, wherein the characteristics of color misregistration in the sub-scanning direction are based on color misregistration relative to a standard color and are dependent on a number of paper sheets on which images are continuously and consecutively formed, the apparatus further comprising:

a counting unit counting the number of paper sheets on which images are continuously and consecutively formed, wherein the controlling unit controls the driving source based on the counted number of paper sheets and the stored characteristics of color misregistration.

8. The color image forming apparatus according to claim 1, wherein the characteristics of color misregistration in the sub-scanning direction are based on color misregistration relative to a standard color and based on an environmental temperature in the apparatus, the apparatus further comprising:

a temperature sensor detecting the environmental temperature in the apparatus;

wherein the controlling unit controls the driving source based on the detected environmental temperature in the apparatus and the stored characteristics of color misregistration.

9. The color image forming apparatus according to claim 8, wherein the temperature sensor is arranged in an exposure device to optically write on the photosensitive drums.

10. The color image forming apparatus according to claim 8, wherein the control unit controls the drive source to increase the average running speed of the endless belt when the detected environmental temperature is detected to be higher than or equal to a predetermined value.

11. The color image forming apparatus according to claim 8, wherein the control unit controls the drive source to decrease the average running speed of the endless belt when the detected environmental temperature is detected to be less than or equal to a predetermined value.

12. The color image forming apparatus according to claim 1, wherein the control unit does not change the average running speed of the endless belt during a transfer process of transferring individual images for a multiple color image.

13. The color image forming apparatus according to claim 1, wherein the endless belt is a paper conveyance belt.

14. The color image forming apparatus according to claim 1, wherein the endless belt is an intermediate transfer belt.

15. A color image forming apparatus comprising:

a plurality of photosensitive drums on which toner images of different colors are respectively formed;

an endless belt confronting the plurality of photosensitive drums;

plural drive source units respectively driving the photosensitive drums to individually rotate;

a memory unit storing pre-measured characteristics of a color misregistration of a color image in a sub-scanning direction of the apparatus, the color image formed by transferring images from respective of the plurality of photosensitive drums; and a control unit changing an average running speed of at least some of the photosensitive drums by controlling the plural drive source units, to compensate for color misregistration, based on the stored characteristics of color misregistration.

16. The color image forming apparatus according to claim 15, wherein said control unit comprises:

a detecting unit detecting information of a running distance of the photosensitive drums and a running speed of the photosensitive drums;

a calculating unit calculating a position deviation or a speed deviation of the photosensitive drums compared with a predetermined target value using the detected position deviation or the detected speed deviation;

an operation unit executing a predetermined feedback operation process based on the calculated position deviation or speed deviation and controlling the driving source based on a result of the feedback operation;

wherein the control unit changes the average running speed of the photosensitive drums by changing the target value based on the stored characteristics of color misregistration.

17. The color image forming apparatus according to claim 16, wherein the characteristics of color misregistration in the sub-scanning direction are based on color misregistration relative to a standard color and are based on an environmental temperature in the apparatus, the apparatus further comprising:

a temperature sensor detecting the environmental temperature in the apparatus, wherein the controlling unit controls the drive source based on the detected environmental temperature in the apparatus and the stored characteristics of color misregistration.

18. The color image forming apparatus according to claim 17, wherein the temperature sensor is arranged in an exposure device to optically write on the photosensitive drums.

19. The color image forming apparatus according to claim 17, wherein the control unit increases the target value when the detected environmental temperature is higher than or equal to a predetermined value.

20. The color image forming apparatus according to claim 17, wherein the control unit decreases the target value when the detected environmental temperature is less than or equal to a predetermined value.

21. The color image forming apparatus according to claim 17, wherein the characteristics of color misregistration in the sub-scanning direction are based on color misregistration relative to a standard color and are dependent on a number of paper sheets on which images are continuously and consecutively formed, the apparatus further comprising:

a counting unit counting the number of paper sheets on which images are continuously and consecutively formed, wherein the controlling unit controls the driving source based on the counted number of paper sheets and the stored characteristics of color misregistration.

22. The color image forming apparatus according to claim 15, wherein the characteristics of color misregistration in the sub-scanning direction are based on color misregistration relative to a standard color and based on an environmental temperature in the apparatus, the apparatus further comprising:

a temperature sensor detecting the environmental temperature in the apparatus;

wherein the controlling unit controls the driving source based on the detected environmental temperature in the apparatus and the stored characteristics of color misregistration.

23. The color image forming apparatus according to claim 22, wherein the temperature sensor is arranged in an exposure device to optically write on the photosensitive drums.

24. The color image forming apparatus according to claim 22, wherein the control unit controls the drive source to increase the average running speed of at least some of the photosensitive drums when the detected environmental temperature is detected to be higher than or equal to a predetermined value.

25. The color image forming apparatus according to claim 22, wherein the control unit controls the drive source to decrease the average running speed of at least some of the photosensitive drums when the detected environmental temperature is detected to be less than or equal to a predetermined value.

26. The color image forming apparatus according to claim 15, wherein the control unit does not change the average running speed of any of the photosensitive drums during a transfer process of transferring individual images for a multiple color image.

27. The color image forming apparatus according to claim 15, wherein the endless belt is a paper conveyance belt.

28. The color image forming apparatus according to claim 15, wherein the endless belt is an intermediate transfer belt.

29. A color image forming apparatus comprising:

a plurality of image forming means on which toner images of different colors are respectively formed;

an endless belt confronting the plurality of image forming means;

means for driving a rotation of the endless belt;

means for storing pre-measured characteristics of a color misregistration of a color image in a sub-scanning direction of the apparatus, the color image formed by transferring images from respective of the plurality of image forming means; and means for changing an average running speed of the endless belt by controlling the means for driving to compensate for the color misregistration based on the stored characteristics of color misregistration.

30. A color image forming apparatus comprising:

a plurality of image forming means on which toner images of different colors are respectively formed;

an endless belt confronting the plurality of image forming means;

plural means for respectively driving the image forming means to individually rotate;

means for storing pre-measured characteristics of a color misregistration of a color image in a sub-scanning direction of the apparatus, the color image formed by transferring images from respective of the plurality of image forming means; and means for changing an average running speed of at least some of the image forming means by controlling the plural means for driving, to compensate for color misregistration, based on the stored characteristics of color misregistration.

31. A color image forming apparatus method for use in an image forming device including a plurality of photosensitive drums on which toner images of different colors are respectively formed and an endless belt confronting the plurality of photosensitive drums, the method comprising:

driving a rotation of the endless belt;

storing pre-measured characteristics of a color misregistration of a color image in a sub-scanning direction of the apparatus, the color image formed by transferring images from respective of the plurality of photosensitive drums; and changing an average running speed of the endless belt by controlling the driving rotation of the endless belt to compensate for the color misregistration based on the stored characteristics of color misregistration.

32. A color image forming method for use in an image forming device including a plurality of photosensitive drums on which toner images of different colors are respectively formed and an endless belt confronting the plurality of photosensitive drums, the method comprising:

driving the photosensitive drums to individually rotate by plural respective drive source units;

storing pre-measured characteristics of a color misregistration of a color image in a sub-scanning direction of the apparatus, the color image formed by transferring images from respective of the plurality of photosensitive drums; and changing an average running speed of at least some of the photosensitive drums by controlling the plural drive source units, to compensate for color misregistration, based on the stored characteristics of color misregistration.

33. A computer readable medium including a computer program for controlling a color image forming apparatus including a plurality of photosensitive drums on which toner images of different colors are respectively formed and an endless belt confronting the plurality of photosensitive drums, the computer program comprising computer implemented instructions to:

drive a rotation of the endless belt;

store pre-measured characteristics of a color misregistration of a color image in a sub-scanning direction of the apparatus, the color image formed by transferring images from respective of the plurality of photosensitive drums; and change an average running speed of the endless belt by controlling the driving rotation of the endless belt to compensate for the color misregistration based on the stored characteristics of color misregistration.

34. A computer readable medium including a computer program for controlling a color image forming apparatus including a plurality of photosensitive drums on which toner images of different colors are respectively formed and an endless belt confronting the plurality of photosensitive drums, the computer program comprising computer implemented instructions to:

respectively drive the photosensitive drums to individually rotate by controlling plural respective drive source units;

store pre-measured characteristics of a color misregistration of a color image in a sub-scanning direction of the apparatus, the color image formed by transferring images from respective of the plurality of photosensitive drums; and change an average running speed of at least some of the photosensitive drums by controlling the plural drive source units, to compensate for color misregistration, based on the stored characteristics of color misregistration.

* * * * *